United States Patent [19]

Ito

[11] 3,973,924

[45] Aug. 10, 1976

[54] PROCESS FOR CONTINUOUSLY CONVERTING COAL INTO A SATURATED HYDROCARBON GAS

[75] Inventor: Shozo Ito, Ichikawa, Japan

[73] Assignee: Mifuji Iron Works, Ltd., Tokyo, Japan

[22] Filed: Nov. 4, 1974

[21] Appl. No.: 520,669

[30] Foreign Application Priority Data

July 8, 1974 Japan ..... 49-077406

[52] U.S. Cl. ..... 48/202; 48/197 R; 48/206

[51] Int. Cl.[2] ..... C10J 3/46; C10J 3/54; C10K 1/00

[58] Field of Search ..... 48/197 R, 202, 210, 48/206

[56] References Cited

UNITED STATES PATENTS

| | | | |
|---|---|---|---|
| 2,840,462 | 6/1958 | Gorin | 48/197 R |
| 3,420,641 | 1/1969 | Milbourne et al. | 48/197 R X |
| 3,481,721 | 12/1969 | Stark | 48/197 R |
| 3,556,749 | 1/1971 | Spacil | 48/202 X |
| 3,698,882 | 10/1972 | Garret et al. | 48/210 |
| 3,840,354 | 10/1974 | Donath | 48/202 |
| 3,854,896 | 12/1974 | Switzer et al. | 48/210 |

*Primary Examiner*—Morris O. Wolk
*Assistant Examiner*—Michael S. Marcus

[57] ABSTRACT

Coal is continuously converted into a saturated hydrocarbon gas containing substantially no unsaturated hydrocarbon and having a high calorific value and a uniform composition by the operations of: providing a first treating gas having a predetermined temperature, pressure and composition, by mixing, in a first conditioning chamber, a first substantially inert burnt gas which has been prepared by burning a mixture of a fuel and air, containing therein 2% by volume or less of free oxygen, with steam and, if necessary, hydrogen gas; thermally cracking, in a first treating chamber, the coal particles with the first treating gas while fluidizing said coal particles; separately providing a second treating gas having a predetermined temperature, pressure and composition by mixing, in a second conditioning chamber, a second substantially inert burnt gas which has been prepared by burning a fuel, and contains therein 2% by volume or less of free hydrogen gas, with hydrogen gas and, if necessary, an additional gas; hydrogenating, in a second treating chamber, the thermally cracked product with the second treating gas while fluidizing the thermally cracked product to generate the saturated hydrocarbon gas and isolating the saturated hydrocarbon gas from the hydrogenation mixture, the hydrogen gas used in the above process being prepared by collecting char from the hydrogenation mixture, converting the char into water-gas containing hydrogen and carbon monoxide gases by treating with a third treating gas containing steam, converting the carbon monoxide into a mixture of hydrogen and carbon dioxide gases by steam treatment and isolating the hydrogen gas from the conversion mixture.

15 Claims, 4 Drawing Figures

PROCESS FOR CONTINUOUSLY CONVERTING COAL INTO A SATURATED HYDROCARBON GAS

The present invention relates to a process for converting coal into saturated hydrocarbon gas, and more particularly, relates to a process for continuously converting coal into saturated hydrocarbon gas by thermally cracking coal and hydrogenating the thermally cracked product.

It is known that saturated hydrocarbon gas is produced from coal by simultaneously carrying out the thermal cracking of the coal and the hydrogenation of the thermal cracked product in the same treating furnace. However, such a process has the following disadvantages:

1. It is very difficult to control the reaction conditions in the treating furnace;
2. there is a high content of unsaturated hydrocarbons in the hydrogenation product, and;
3. there is a large variation in the composition of the resultant hydrogenation product, especially in unsaturated hydrocarbon gas.

Another known process is to produce saturated hydrocarbon gas from coal by generating carbon monoxide from coal and hydrogenating the carbon monoxide to generate methane. This is the so-called methanation process. The hydrogenation in the methanation process can be effected only by using a catalyst which greatly increases the cost of the process. Further, since the hydrogenation generates heat which results in an interruption of the uniform hydrogenation, it is necessary to strictly control the reaction temperature (heat balance) during the hydrogenation period, although this is undesirable.

The object of the present invention is to provide a process for continuously producing saturated hydrocarbon gas from coal, which gas contains substantially no unsaturated hydrocarbon and is uniform in composition.

The other object of the present invention is to provide a process for continuously converting coal into saturated hydrocarbon gas, in which process the processing conditions are easily regulated.

The above-mentioned objects can be accomplished by the process of the present invention for continuously converting coal into saturated hydrocarbon gas by thermally cracking coal which has been previously finely divided, with steam and hydrogenating the thermal cracked product with hydrogen gas, which process includes an improvement comprising the steps of:

1. preparing a first substantially inert burnt gas containing therein at most 2% by volume of free oxygen, by burning a fuel;
2. in order to provide said first treating gas, mixing, in a first conditioning chamber, the inert burnt gas with steam and, if necessary, hydrogen gas in such a proportion that the resulting first treating gas has a predetermined temperature, pressure and composition;
3. treating, in a first treating chamber, coal which has been finely divided, with the first treating gas while fluidizing the divided coal, to thermally crack it;
4. separately preparing a second substantially inert burnt gas containing therein at most 2% by volume of free oxygen, by burning a fuel;
5. in order to provide a second treating gas, mixing, in a second conditioning chamber, said inert burnt gas prepared in step 4 with hydrogen gas and, if necessary, an additional gas for regulating the temperture of the second treating gas, in such a proportion that the resulting second treating gas has a predetermined temperature, pressure and composition;
6. treating, in a second treating chamber, said thermal cracked product of step 3 with said second treating gas, while fluidizing said thermal cracked product to hydrogenate it and generate saturated hydrocarbon gas; and
7. isolating said saturated hydrocarbon gas from the hydrogenation mixture in step 6.

The distinctive feature of the process of the present invention is in the fact that the thermal cracking step and the hydrogenation step are carried out separately in different treating chambers (i.e., the first and second treating chambers), the treating gas for the thermal cracking step (the first treating gas) and the treating gas for the hydrogenation step (the second treating gas) are prepared separately in different chambers, (i.e., the first and second conditioning chambers), the first and second treating gases are independently adjusted to the desired temperature, pressure and composition, the thermal cracking of the finely divided coal is carried out while fluidizing the coal in the first treating chamber, and the hydrogenation of the thermally cracked product is effected while fluidizing the product in the second treating chamber.

The present invention further provides a process for generating hydrogen gas from char separated from the hydrogenation mixture and supplying said hydrogen gas to the hydrogenation step 5 and, if necessary, to the coal decomposition step 2. That is, in the above-mentioned process of the present invention, the hydrogen gas used in the hydrogenation step 5 and, if necessary, the coal decomposition step 2 is generated and supplied by the following steps:

a. collecting char from said hydrogenation mixture in step 6, b. preparing a third substantially inert burnt gas containing therein at most 2% by volume of free oxygen by burning a fuel, c. preparing, in a third conditioning chamber, a third treating gas by mixing said third burnt gas in the above-mentioned step with steam in such a proportion that the resulting third treating gas has a predetermined temperature, pressure and composition;

d. treating, in a third treating chamber, the char with said third treating gas while fluidizing the char, to convert the char into water-gas containing hydrogen and carbon monoxide;

e. treating said water-gas with steam to convert the carbon monoxide in the water-gas into a mixture of hydrogen and carbon dioxide;

f. isolating the hydrogen gas from the above-mentioned conversion mixture, and g. supplying the hydrogen gas to step (5) and, if necessary, to step (2).

The hydrogen gas generating process is characterized in that the third treating gas is prepared in the third conditioning chamber separate from the third treating chamber so as to have the predetermined temperature, pressure and composition, while the char is fluidized in the third treating chamber.

The features and constitution of the process of the present invention will be more clearly understood by reading the following description with reference to the accompanying drawings, in which.

Figure 1:
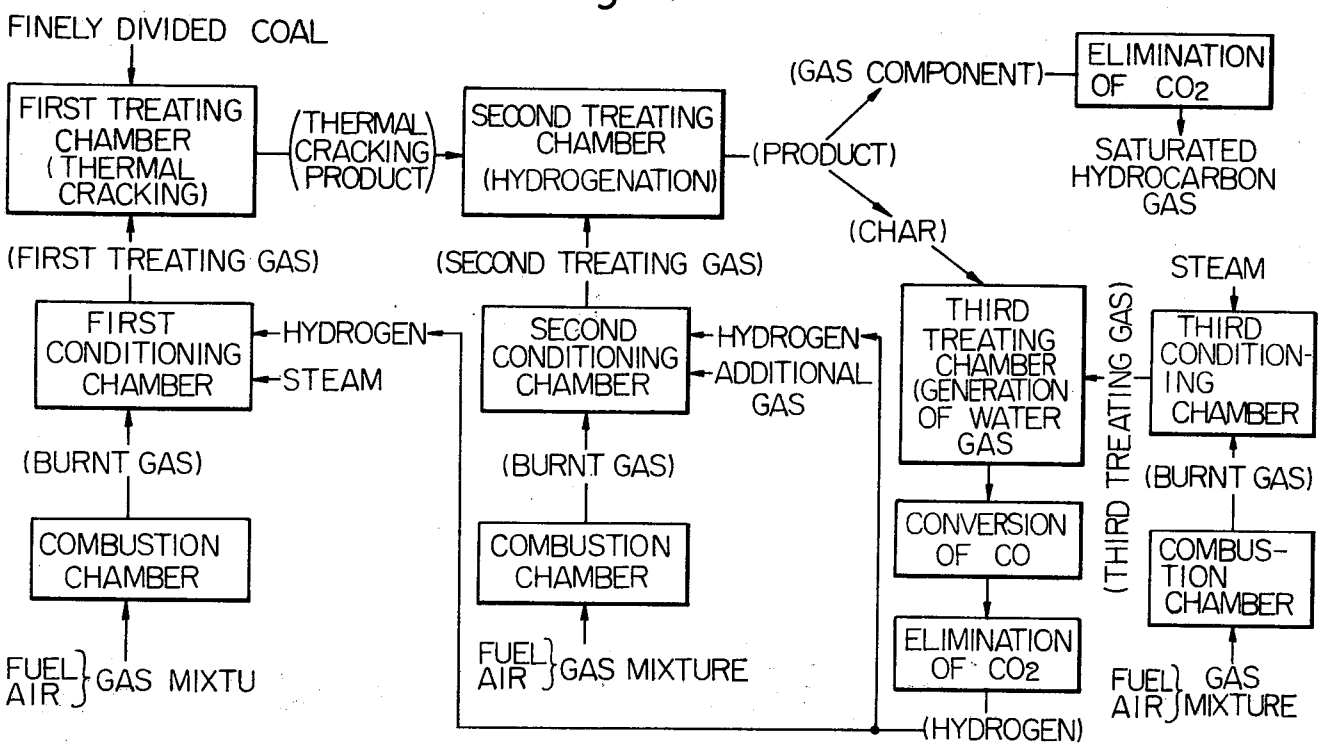
FIG. 1 shows a typical flow sheet of the process of the present invention.

Referring to FIG. 1 which is a flow sheet indicating the process of the present invention, in order to prepare the first burnt gas for coal cracking, a fuel is mixed with air or oxygen gas in predetermined proportions in a mixing chamber, the mixture is fed into a combustion chamber and is then burnt therein.

The fuel may be optionally selected from ordinary gas fuels, for example, oil gas, natural gas, propane gas, the saturated hydrocarbon gas produced by the process of the present invention, town gas, water gas; ordinary liquid fuels, for example, light oil, heavy oil and liquefied coal oil; and, if necessary, finely divided solid fuels, for example, coal coke and charcoal, unless the resultant burnt gas would affect the thermal cracking of the coal. In the mixing chamber, the fuel is uniformly mixed with air or oxygen gas in such a proportion that the resultant burnt gas contains at most 2% by volume of free oxygen gas and is therefore substantially inert. The mixture proportion of the fuel and air or oxygen gas is determined in response to the type and grade of the fuel to be used and the type of combustion chamber. The first burnt gas thus prepared is fed into the first conditioning chamber and mixed therein with a predetermined amount of steam or water, in order to prepare the first treating gas. When water is used, it is vaporized as soon as the water contacts the burnt gas in the first conditioning chamber. If it is necessary, a predetermined amount of hydrogen gas may be fed into the first conditioning chamber and mixed with the burnt gas and steam or water. In the preparation of the first treating gas, the proportion of burnt gas, steam or water and, if necessary, hydrogen gas, is determined in response to the temperatures and pressures of the burnt gas, steam or water and hydrogen gas, and the composition of the burnt gas, so that the resultant first treating gas has a predetermined temperature, pressure and composition. Generally, the first treating gas has a preferable temperature of 400° to 600°C, and more preferably, 450° to 550°C, and a preferable pressure of 25 to 50 kg/cm$^2$, more preferably, 30 to 40 kg/cm$^2$, and preferably contains 0.25 to 0.5 kg, more preferably, 0.3 to 0.4 kg of steam per 1 kg of coal to be converted and, if necessary, 0.4 to 0.7 Nm$^3$, more preferably, 0.5 to 0.6 Nm$^3$, of hydrogen gas per 1 kg of said coal to be converted.

The first treating gas thus prepared is fed into the first treating chamber within the coal is thermally cracked. The coal in a finely divided form is supplied into the first treating chamber so as to meet the first treating gas. The finely divided coal is fluidized and thermally cracked by the first treating gas within the first treating chamber.

Figure 2:
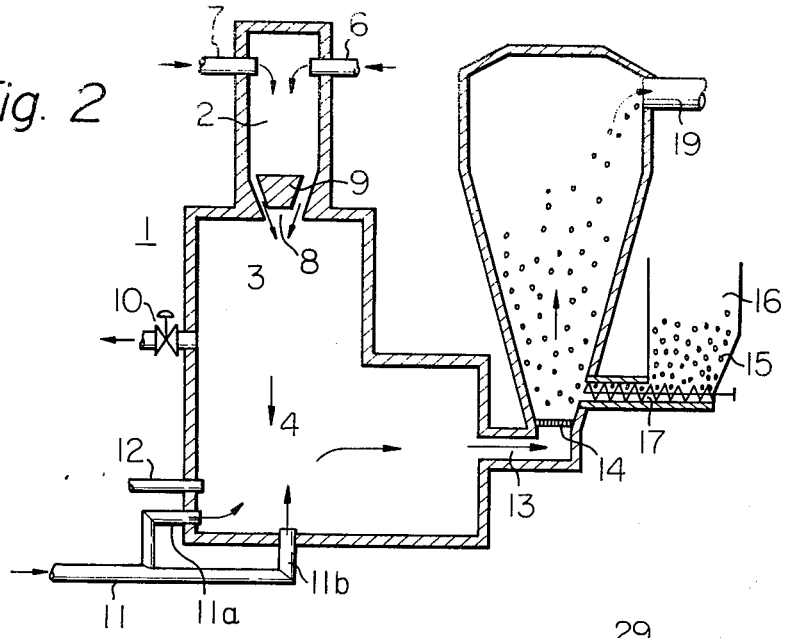
FIG. 2 is an explanatory cross-sectional view of an embodiment of the apparatus for effecting the process of the present invention.

The thermal cracking of the coal may be carried out in the apparatus indicated, for example, in FIG. 2. Referring to FIG. 2, a coal cracking apparatus 1 is provided with a mixing chamber 2, a combustion chamber 3, a first conditioning chamber 4 and a first treating chamber (thermal cracking chamber) 5. The mixing chamber 1 is provided with a conduit 6 for feeding a fuel and a conduit 7 for supplying air or oxygen gas. The fuel supplied through the conduit 6 is uniformly mixed with air or oxygen gas supplied through the conduit 7 in the mixing chamber 2. The mixing chamber 2 has therein a cylindrical internal space having an inside periphery which extends in the same direction as that of the flow of the gas mixture. An exit end of the mixing chamber 2 forms an opening 8 through which the gas mixture is ejected from the mixing chamber 2 into the combustion chamber 3. The ejecting opening 8 may be provided with a device for controlling the flow of the gas mixture therethrough. The flow control device can regulate the flow rate, flow velocity and flow direction of the gas mixture so as to attain the desired levels. An example of the flow control device is shown in FIG. 2. That is, the exit end of the mixing chamber 2 has a circular cone shape converging toward the combustion chamber 3. In the circular cone-shaped space, a flow regulator 9 is located. The flow regulator 9 also has a circular cone shape converging toward the combustion chamber 3 and is movable so as to adjust the effective cross-sectional area of the ejecting opening 8. By adjusting the position of the flow regulator 9, the gas mixture's flow velocity, flow rate and flow direction can be regulated and can be diffused uniformly into combustion chamber 3. When this happens, the gas mixture is ignited and is uniformly and completely burnt therewithin. Combustion chamber 3 is provided with a cylindrical internal space having an inside periphery which extends along the direction of the flow of the burnt gas in the internal space. In order to completely burn the gas mixture in combustion chamber 3, it is preferable that the inside diameter of combustion chamber 3 satisfies the following relationship:

$$dc \geqq 1\tfrac{1}{4}\, dM \qquad 1.$$

wherein dc represents the inside diameter of the internal space of combustion chamber 3 and dM represents the inside diameter of the ejecting opening 8. A dc smaller than 1 ¼ dM may result in the inperfect combustion of the gas mixture. The first burnt gas thus prepared has a high temperature and contains therein at most 2% by volume of free oxygen. The first burnt gas is introduced from combustion chamber 3 into first conditioning chamber 4. If it is desired, a portion of the first burnt gas may be withdrawn through a discharge conduit 10. The first conditioning chamber 4 is provided with main branch conduits 11*a* and 12*b* connected to a main conduit 11 for feeding steam water. The first conditioning chamber may have, if necessary, a conduit 12 for feeding hydrogen gas into it. The flow rates of the steam or water and, if necessary, the hydrogen gas to be mixed with the burnt gas, are determined in response to the temperature, pressure and composition of the first treating gas prepared within the first conditioning chamber 4.

In order to uniformly mix the first burnt gas and steam and, if necessary, hydrogen gas, and to prepare a uniform first treating gas, it is preferable that the first conditioning chamber has an internal space satisfying the following relationship:

$$1\tfrac{1}{2}\, Vc \leqq V_A$$

wherein Vc represents the volume of the internal space of the combustion chamber and $V_A$ represents the volume of the internal space of the first conditioning chamber. A $V_A$ smaller than 1 ½ Vc may cause non-uniform mixing of the burnt gas and steam and, if necessary, hydrogen gas.

The first treating gas thus uniformly prepared is supplied from the first conditioning chamber 4 into the first treating chamber 5 through a supply path 13. The first treating chamber 5 may have a slit or grid 14 which is optional, and which can be located at the inlet end of chamber 5. The finely divided coal 15 is fed from a hopper 16 into the entrance of the first treating chamber 5 by means of a screw conveyor 17. The coal 15 thus fed is fluidized by a stream of the first treating gas and thermally cracked by the action thereof. The thermal cracked product of the coal consists of a mixture of cracked gas substances, tar (paper-like) substances and char. After thermal cracking is completed, the thermally cracked product is discharged from the first treating chamber through a discharge conduit 19, while being fluidized in the first treating gas.

Referring to FIG. 1, the thermally cracked product thus produced in the first treating chamber, is sent to the second treating chamber's hydrogenation chamber wherein the thermal cracked product is hydrogenated. For the purpose of providing a hydrogenating gas, a second treating gas is prepared by the following method. In the same manner as in the preparation of the first treating gas, a uniform mixture of a fuel and air or oxygen gas is ejected into a combustion chamber and ignited therein to prepare a second substantially inert burnt gas containing therein at most 2% by volume of oxygen gas. The second burnt gas is fed into a second conditioning chamber. Hydrogen gas is fed separately, into the second conditioning chamber and is mixed uniformly with the second burnt gas therewithin to prepare a second treating gas. If it is necessary, an additional gas, for example, steam (or water) may be fed into the second conditioning chamber and mixed with the second treating gas in order to regulate the temperature, pressure and composition of the second treating gas. The feed rate of the hydrogen gas and, if necessary, the additional gas, is determined in response to the temperature and pressure of the burnt gas, hydrogen gas and the additional gas and of the composition of the burnt gas and the additional gas so as to obtain the desired second treating gas having a predetermined temperature, pressure and composition.

Generally, it is preferable that the second treating gas should have a temperature of 600° to 800°C, more preferably, 650° to 750°C, a pressure of 20 to 50 kg/cm$^2$, more preferably, 30 to 40 kg/cm$^2$ and should contain hydrogen gas in an amount of 1.1 to 1.6 Nm$^3$, more preferably, 1.25 to 1.45 Nm$^3$ per 1 kg of the coal to be converted.

The additional gas, water or steam is usually used in the desired amount for regulating the temperature, pressure and composition of the second treating gas.

Figure 3:
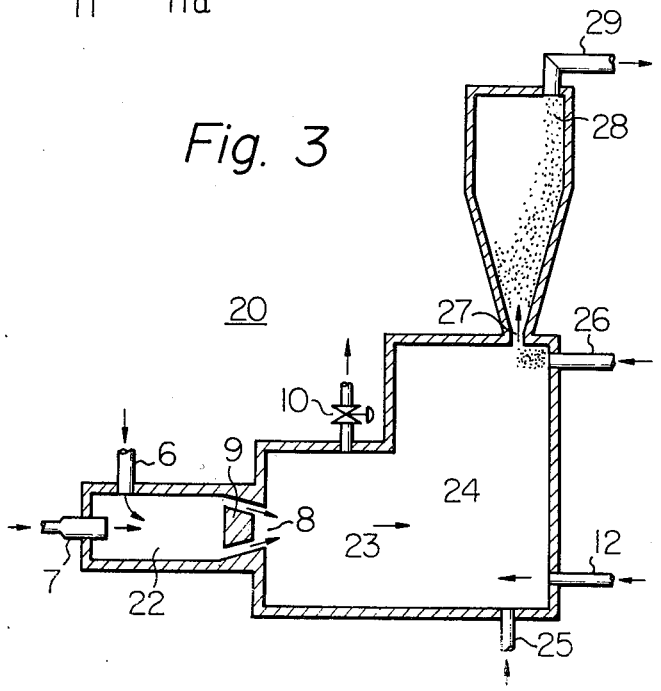
FIG. 3 is an explanatory cross-sectional view of another embodiment of the apparatus for effecting the process of the present invention.

For the hydrogenation of the thermally cracked product, the apparatus as shown in FIG. 3, for example, may be utilized.

Referring to FIG. 3, the apparatus 20 is provided with a mixing chamber 22, a combustion chamber 23, a second conditioning chamber 24 and a second treating chamber (hydrogenation chamber) 28. The mixing chamber 22 and the combustion chamber 23 in FIG. 2 have the same structure as those in FIG. 3, except that the cylindrical internal spaces of the mixing chamber 22 and the combustion chamber 23 in FIG. 3 extend horizontally whereas those in FIG. 2 extend vertically. The second conditioning chamber 24 has a conduit 12 for feeding hydrogen gas and, if necessary, a conduit 25 for feeding additional gas. Further, a conduit 26 for feeding the thermally cracked product is connected to a part of the second conditioning chamber 24 which is close to the exit opening 27. The second treating gas is prepared within the second conditioning chamber 24 so as to have the desired temperature, pressure and composition and is then mixed with the thermal cracked product fed into the portion close to the exit opening 27. The thermally cracked product is introduced together with the second treating gas into the second treating chamber 28. The gas component in the thermally cracked product is uniformly mixed into the second treating gas and the liquid and solid components of the thermally cracked product are uniformly suspended in the second treating gas.

All of the components of the thermally cracked product are hydrogenated so as to generate the saturated hydrocarbon gas.

The thermal cracked product feed conduit 26 may be connected to a portion of the second treating chamber 28 close to the opening 27. In this case, the thermally cracked product is fluidized in the second treating chamber 28 by the stream of the second treating gas introduced through opening 27.

The reaction mechanism of the hydrogenation of the thermal cracked product is not completely clear, but is assumed to be as follows.

1. Hydrogenation of the gas component $$C_2H_4 + 2H_2 + 2CH_4$$

$$C_2H_4 + H_2 = C_2H_6$$

$$C_2H_6 + 3H_2 = 3CH_4$$

$$CO + 3H_2 = CH_4 + H_2O$$

It is supposed that the last reaction occurs to only a slight degree, or even may not take place at all.

2. Hydrogenation of the liquid component (tar)

$$C_nH_{2n+2} + (n\text{-}1)H_2 = nCH_4$$

3. Hydrogenation of the solid component (char)

$$C + 2H_2 = CH_4$$

All of the above hydrogenation reactions are exothermic reactions. That is, the heat generated during the hydrogenation period causes an elevation of the temperature of the hydrogenation mixture in the second treating chamber. Accordingly, it is sometimes necessary to add an additional gas into the second treating gas so as to regulate the temperature of the hydrogenation mixture to a desired level.

The additional gas may be a portion of the discharge gas from the second treating chamber. Said portion is fed into a heat-exchanger and mixed with a desired amount of steam or water to adjust the temperature of the discharge gas to a desired level.

The hydrogenation mixture is discharged from the second treating chamber 28 through a discharge conduit 29 into a separating device (not shown in the drawings), for example, a cyclone dust collector wherein the char is separated from a gas mixture.

The char is collected by a cyclone dust collector and the gas mixture is fed into a device, for example, a refining column, for isolating saturated hydrocarbon gas. The residual gas containing carbon dioxide and hydrogen sulfide is eliminated by the refining column. The saturated hydrocarbon gas thus produced and isolated mainly consists of methane and ethane and includes almost no unsaturated hydrocarbon, and a small amount of carbon monoxide and hydrogen. Such a type of saturated hydrocarbon gas has a high calorific value.

The hydrogen gas to be used in the hydrogenation step and, if necessary, in the thermal cracking step, may be supplied at any time from the hydrogen supply source. The hydrogen gas may be generated and supplied in accordance with the process of the present invention.

Referring to FIG. 1, the char is collected from the hydrogenation mixture and converted into water gas. The conversion of the char is carried out in the following manner.

A gas mixture is prepared by uniformly mixing a fuel with air or oxygen gas within a mixing chamber and is then burnt in a combustion chamber to provide a third substantially inert burnt gas containing at most 2% by volume of free oxygen gas. The third burnt gas is introduced into a third conditioning chamber. Steam or water are fed separately, into said third conditioning chamber and are uniformly mixed with the burnt gas to prepare a third treating gas. The mixing ratio of the third burnt gas to steam or water is determined in response to the temperature, pressure and composition of the burnt gas and the temperature and pressure of the steam or water, so that the resultant third treating gas has a predetermined pressure, temperature and composition. The third treating gas is fed into a third treating chamber and converts the char to water-gas while fluidizing the char within said third treating chamber. That is, the char is converted into water-gas consisting of hydrogen, carbon dioxide and carbon monoxide.

The third treating gas should preferably have a temperature of 800° to 1000°C, more preferably, 850° to 950°C with a pressure of 20 to 50 kg/cm$^2$, more preferably, 30 to 40 kg/cm$^2$ and should contain preferably 0.4 to 0.8 kg, or better still 0.5 to 0.7 kg, of steam per 1 kg of the char to be converted.

The water gas is treated with steam at a temperature of 400° to 450°C in order to convert the carbon monoxide gas contained in the water-gas and steam into hydrogen gas and carbon dioxide gas. The resultant converted water-gas is subjected to a conventional process for eliminating the carbon dioxide gas by isolating the hydrogen gas. The isolated hydrogen gas is fed into the second conditioning chamber and, if necessary, into the first conditioning chamber as well. That is, the hydrogen gas is utilized for hydrogenation of the thermal cracked product, and if necessary, for thermal cracking of the coal.

Figure 4:
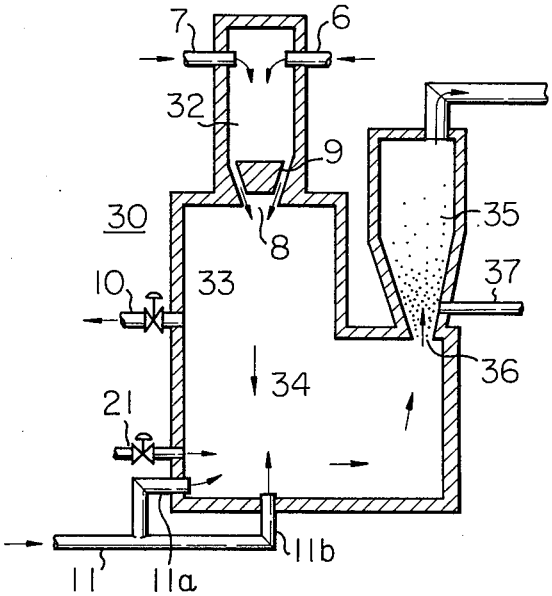
FIG. 4 is an explanatory cross-sectional view of still another embodiment of the apparatus for carrying out the process of the present invention.

The process for generating the hydrogen gas from the char may be carried out by using the apparatus as shown, for example, in FIGS. 2, 3 or 4. Referring to FIG. 4, the apparatus 30 is provided with a mixing chamber 32, a combustion chamber 33, a third conditioning chamber 34 and a third treating chamber 35 (water-gas generating chamber). The mixing chamber 32, the combustion chamber 33, and the third conditioning chamber 34 have similar structures to those in FIG. 2. A conduit 21 connected to the third conditioning chamber 34 may be utilized for feeding an additional gas, for example, a portion of the burnt gas which has been withdrawn through the conduit 10 from the combustion chamber 33, and has been brought to the desired temperature and pressure. The additional gas is used for the purpose of regulating the temperature, pressure and composition of the third treating gas.

The char is fed into the third treating chamber 35 through a conduit 37 disposed close to the exit opening 36 of the third conditioning chamber 34. The char thus fed is fluidized within the third treating chamber 35 by the stream of the third treating gas, and converted into water-gas by the action of said third treating gas. The water-gas thus generated is sent into an apparatus (not shown in the drawing) for converting the carbon monoxide into hydrogen and carbon dioxide, with steam.

In the process of the present invention, the thermal cracking of coal and the hydrogenation of the thermal cracked product and, if necessary, the conversion of the char into water-gas, are respectively carried out in separate treating chambers using separate treating gases each of which is independently conditioned to the most pertinent temperature, pressure and composition, while separately fluidizing the coal, the thermal cracking product and the char in separate treating gases. This feature distinguishes the process of the present invention from the conventional processes. Due to the above-mentioned feature of the process of the present invention, all of the reactions are uniformly carried out with high efficiency, at a high yield and at a high velocity. Further, since each of the reactions is simplified in the reaction conditions, easy operational control of the reactions is facilitated. The saturated hydrocarbon gas produced by the process of the present invention does not include a substantial amount of unsaturated hydrocarbon, has only small amounts of hydrogen and carbon monoxide gases, and has a high calorific value. The features and advantages of the process of the present invention are further illustrated by the following example, which is not intended to limit the scope of the present invention.

EXAMPLE

A system for converting coal into saturated hydrocarbon gas was provided by connecting the apparatuses of FIGS. 2, 3 and 4 in accordance with the flow sheet indicated in FIG. 1.

The coal to be converted was a non-caking coal divided into fine particles of 15 to 80 mesh size.

The non-caking coal was subjected to the following process.

1. Thermal cracking of the coal

Thermal cracking was carried out by using the apparatus of FIG. 2. A saturated hydrocarbon gas which was prepared by the process of the present invention and which contained about 91% by volume of a sum of methane and ethane, about 6.5% by volume of hydrogen and about 2.5% by volume of carbon monoxide, was used as a fuel gas. The fuel gas was preheated to a temperature of 150°C and fed into the mixing chamber at a flow rate of 40 Nm$^3$/hour. Air was preheated separately, to a temperature of 180°C and fed into the mixing chamber at a flow rate of 400 Nm$^3$/hour and uniformly mixed with the fuel gas therein. The fuel gas mixture was ejected in to the combustion chamber having an inside diameter (dc) of 40 cm and an inside volume (Vc) of 0.07 $m^3$ through an ejecting opening having an inside diameter (dM) of 1.0 cm, and ignited so as to completely burn the fuel gas mixture. The resultant burnt gas contained therein a very small amount, 0.2% volume, of free oxygen gas and, therefore, was substantially inert. The burnt gas was then introduced into the first conditioning chamber having an inside volume of 0.15 $m^3$. Steam at a temperature of 107°C was separately introduced into the first conditioning chamber at a flow rate of 35 kg/hour and simultaneously, hydrogen gas at room temperature was fed thereinto at a flow rate of 55 $Nm^3$/hour. The burnt gas was uniformly mixed with the steam and hydrogen gas within the first conditioning chamber. The resultant first treating gas had a temperature of 500°C and a pressure of 37 $kg/cm^2$, and was introduced into the first treating chamber, at the same time, that the finely divided coal was fed into it at a supply rate of 100 kg/hour. The coal was fluidized and thermally cracked by the first treating gas. The thermal cracked product was discharged from the first treating chamber and forwarded to the second treating chamber.

2. Hydrogenation of the thermal cracked product.

For the hydrogenation of the thermal cracked product, the apparatus shown in FIG. 3 was utilized. The same fuel used in the thermal cracking process was preheated to a temperature of 150°C and fed into the mixing chamber at a flow rate of 20 $Nm^3$/hour. Air was separately preheated to a temperature of 180°C and supplied into the mixing chamber at a flow rate of 200 $Nm^3$/hour and uniformly mixed with the fuel within the mixing chamber. The fuel gas mixture was ejected from the mixing chamber into a combustion chamber having an inside diameter (dc) of 30 cm and an inside volume (Vc) of 0.05 $m^3$ through an ejecting opening having an inside diameter of 0.6 cm and was ignited so as to completely burn the fuel gas mixture. The resultant burnt gas contained therein was less than 0.2% by volume of free oxygen and, therefore, was substantially inert. The burnt gas was introduced into the second conditioning chamber having an inside volume (VA) of 0.10 $m^3$. At the same time, hydrogen gas at room temperature was fed into the second conditioning chamber at a flow rate of 135 $Nm^3$ and was uniformly mixed with the burnt gas so as to prepare the second treating gas. The second treating gas had a temperature of 700°C and a pressure of 40 $kg/cm^2$.

The thermally cracked product was fed into a portion of the second conditioning chamber very close to the exit opening thereof and introduced into the second treating chamber by the stream of the second treating gas. Said thermally cracked product was fluidized and hydrogenated by the second treating gas within the second treating chamber. The hydrogenation mixture discharged from the second treating chamber was forwarded for aftertreatment.

3. Aftertreatment (isolating of saturated hydrocarbon gas).

The hydrogenation mixture was fed into a cyclone dust collector to separate and collect the char from the hydrogenation mixture, and thereafter, the gas residue was sent to a column for eliminating carbon dioxide and hydrogen sulfite from the gas residue. As a result of the aftertreatment, the saturated hydrocarbon gas was collected at a rate yielding 65 $Nm^3$/hour. The saturated hydrocarbon gas thus obtained contained approximately 90.8% by volume of a sum of methane and ethane, approximately 6.5% of hydrogen, approximately 2.7% of carbon monoxide and a very small amount of unsaturated hydrocarbon. The saturated hydrocarbon gas was pressurized, and stored in a pressurized gas storage tank.

The char separated from the hydrogenation mixture was forwarded to the water gas generating apparatus.

4. Preparation of Hydrogen Gas

The char was converted into water-gas by using the apparatus shown in FIG. 4. The same fuel gas utilized in the above-mentioned thermal cracking process for coal was used. The fuel gas and air were preheated to temperatures of 150°C and 180°C, and fed into the mixing chamber at flow rates of 80 $Nm^3$/hour and 800 $Nm^3$/hour, respectively. The fuel gas and air were uniformly mixed in the mixing chamber. The fuel mixture gas was ejected from the mixing chamber into the combustion chamber having an inside diameter (dc) of approximately 3.5 cm and an inside volume (Vc) of approximately 0.3 $m^3$, through an ejecting opening having an inside diameter (dM) of 2 cm, and was ignited in order to prepare a burnt gas. The resultant burnt gas included therein a small amount, about 0.2%, of free oxygen gas and was therefore essentially inert. The burnt gas thus prepared was introduced into the third conditioning chamber having an inside volume of 0.7 $m^3$. Steam at a temperature of 107°C was separately fed into the third conditioning chamber at a flow rate of 60 kg/hour, and uniformly mixed with the burnt gas in order to prepare the third treating gas which had a temperature of 900°C and a pressure of 35 $kg/cm^3$.

Char was supplied at a rate of 100 kg/hour into the lower portion of the third treating chamber close to the exit opening of the third conditioning chamber. The char thus supplied was fluidized by the stream of the third treating gas introduced into the third treating chamber and was converted into water-gas. Said water-gas was sent into a carbon monoxide converter, wherein the carbon dioxide in the water-gas was converted, utilizing steam, into a mixture of carbon monoxide and hydrogen gas. The resultant gas mixture was fed into a column for isolating hydrogen gas by eliminating the carbon monoxide gas and other impurities. The hydrogen gas thus isolated was pressurized and collected in a pressurized storage tank, and supplied, at necessary intervals, to the second conditioning chamber at a rate of 135 $Nm^3$/hour and, if necessary, to the first conditioning chamber at a rate of 55 $Nm^3$/hour.

COMPARATIVE EXAMPLE 1

The same non-caking coal as in the Example was directly converted to hydrocarbon gas by using the apparatus shown in FIG. 2. The treating gas was prepared by uniformly mixing, in the conditioning chamber, the burnt gas introduced from the combustion chamber, with steam and hydrogen gas. The treating gas thus obtained had a temperature of 700°C and a pressure of 35 $kg/cm^2$ and contained 0.8 kg of steam and 1.9 $Nm^3$ of hydrogen gas per 1 kg of the coal to be converted. The treating gas was introduced into the treating chamber. At the same time, coal was supplied into the treating chamber at a supply rate of 100 kg/hour. The coal was fluidized and simultaneously thermally cracked, and the thermally cracked product was hydrogenated, in the treating chamber. The resultant hydrogenation mixture was aftertreated by the same method as in the Example so as to isolate the resultant hydrocarbon gas. The hydrocarbon gas thus obtained contained 73.1% by volume of a sum of methane and ethane, 3.8% by volume of carbon monoxide gas, 12.5% by volume of hydrogen gas and 10.6% by volume of unsaturated hydrocarbon gas.

From the above-mentioned result, it is clear that the conventional process wherein the coal is directly converted results in a hydrocarbon gas containing an undesirably large amount of the unsaturated hydrocarbon gas and relatively large amounts of carbon monoxide and hydrogen gases, even if the desired treating gas is prepared in the conditioning chamber separately from the treating chamber.

COMPARATIVE EXAMPLE 2

The same non-caking coal used in the Example was fed at a feed rate of 100 kg/hour into a treating chamber similar to that in FIG. 2. At the same time, the same fuel gas as used in the example, together with oxygen, steam and hydrogen gases were blown into the treating chamber at feed rates of 0.6 $Nm^3$/hour, 0.9 $Nm^3$/hour, 0.5 kg/hour and 0.9 $Nm^3$/hour. The coal was fluidized by the stream of the gases in the treating chamber and a portion of the coal was burnt to raise the temperature of the treating chamber to 750° to 800°C. The remaining coal was treated with the gas mixture in the treating chamber. The treating mixture was subjected to the same aftertreatment so as to isolate the resultant hydrocarbon gas. The hydrocarbon gas thus obtained contained 64.4% by volume of a sum of methane and ethane, 4.1% of carbon monoxide, 16.2% of hydrogen and 15.3% of unsaturated hydrocarbons.

The above result clearly shows that the conventional process in which a portion of the coal is burnt and at the same time, the remaining coal is directly converted into the hydrocarbon gas in a single treating chamber, results in hydrocarbon gas having a large amount of unsaturated hydrocarbons, hydrogen gas and carbon monoxide and a relatively small amount of saturated hydrocarbons. That is, the content of the saturated hydrocarbons in the hydrocarbon gas prepared in Comparative Example 2 is about ⅔ that of the Example in accordance with the process of the present invention.

What we claim is:

1. In a process for continuously converting coal into a saturated hydrocarbon gas, in which fuel is burned to provide substantially inert gas, which gas is treated with steam, and coal is cracked in the presence of the product, the steps which comprise:

1. burning a fuel to prepare a first substantially inert burnt gas containing therein at most 2% by volume of free oxygen, and feeding the first inert burnt gas into a first conditioning chamber;
2. in the first conditioning chamber mixing the first inert burnt gas with steam to form a first treating gas which has a predetermined temperature between 400° and 600°C, a predetermined pressure between 25 and 50 kg/$cm^2$ and a predetermined composition including 0.25 to 0.5 kg of steam per kilogram of coal to be converted and introducing the first treating gas thus prepared into a first treating chamber;
3. thermally cracking finely divided coal in the first treating chamber with the first treating gas while fluidizing the coal;
4. separately from steps 1 – 3 burning fuel to prepare a second substantially inert burnt gas separately from said first inert burnt gas, said second gas containing therein at most 2% by volume of free oxygen, and feeding the second inert burnt gas into a second conditioning chamber maintained separately from said first conditioning chamber;
5. mixing said second burnt gas with hydrogen gas in the second conditioning chamber to provide a second treating gas which has a predetermined temperature between 600° and 800°C, a predetermined pressure between 20 and 50 kg/$cm^2$ and a predetermined composition including therein 1.1 to 1.6 $Nm^3$ of hydrogen gas per kilogram of coal to be converted, and introducing said second treating gas thus provided into a second treating chamber;
6. conveying to and hydrogenating in a second treating chamber, said thermally cracked product from cracking step (3) with said second treating gas while fluidizing said thermally cracked product, and
7. isolating the resulting saturated hydrocarbon gas from the hydrogenation mixture in step (6).

2. A process as claimed in claim 1, wherein said temperature of said first treating gas is between 450° to 550°C.

3. A process as claimed in claim 1, wherein said pressure of said first treating gas is in the range of 30 to 40 kg/$cm^2$.

4. A process as claimed in claim 1, wherein the amount of said steam in said first treating gas is between 0.3 to 0.4 kg per 1 kg of coal to be converted.

5. A process as claimed in claim 1, wherein the temperature of said second treating gas is between 650° to 750°C.

6. A process as claimed in claim 1, wherein the pressure of said second treating gas is between 30 to 40 kg/$cm^2$.

7. A process as claimed in claim 1, wherein the amount of said hydrogen gas in said second treating gas is between 1.25 to 1.45 $Nm^3$ per 1 kg of coal to be converted.

8. A process as claimed in claim 1, wherein the second inert burnt gas and hydrogen gas are further mixed with an additional gas in the second conditioning chamber to provide the second treating gas, said additional gas being effective for adjusting the temperature of the second treating gas.

9. A process as claimed in claim 1, wherein said hydrogen gas used in step (5) is generated and supplied by the steps of:

collecting char from hydrogenation mixture in step (6), preparing a third substantially inert burnt gas containing therein at most 2% by volume of free oxygen gas by burning a fuel;

preparing, in a third conditioning chamber, a third treatment gas by mixing said burnt gas in the above-mentioned step to provide a third treating gas having a predetermined temperature between 800° and 1000°C, a predetermined pressure between 20 and 50 kg/$cm^2$ and a predetermined composition including therein 0.4 to 0.8 kg of steam per 1 kg of coal to be treated;

treating, in a third treating chamber, said char with said third treating gas while fluidizing said char, to convert said char into water-gas containing hydrogen and carbon monoxide;

treating said water gas with steam so as to convert the carbon monoxide in said water-gas into a mixture of hydrogen and carbon dioxide;

isolating the hydrogen gas from said conversion mixture, and supplying said hydrogen gas to step (5).

10. A process as claimed in claim 9, wherein the temperature of said third treating gas is between 850° to 950 °C.

11. A process as claimed in claim 9, wherein the pressure of said third treating gas is between 30 to 40 kg/cm$^2$.

12. A process as claimed in claim 9, wherein the amount of said steam in said third treating gas is between 0.5 to 0.7 kg per 1 kg of coal to be treated.

13. A process as claimed in claim 1, wherein the first inert burnt gas and steam are further mixed with hydrogen gas in the first conditioning chamber, to provide the first treating gas.

14. A process as claimed in claim 13, wherein the first treating gas contains therein 0.4 to 0.7 Nm$^3$ of hydrogen gas per 1 kg of coal to be converted.

15. A process as claimed in claim 14, wherein the amount of said hydrogen gas in said first treating gas is between 0.5 to 0.6 Nm$^3$ per 1 kg of coal to be converted.

* * * * *